United States Patent [19]

Klukis

[11] 4,327,616

[45] May 4, 1982

[54] COB SAW

[75] Inventor: Edward L. Klukis, Salem, Oreg.

[73] Assignee: Stayton Canning Company Cooperative, Stayton, Oreg.

[21] Appl. No.: 126,402

[22] Filed: Feb. 29, 1980

[51] Int. Cl.[3] ..... B26D 7/06

[52] U.S. Cl. ..... 83/409.2; 83/151; 83/155.1; 83/435.2; 99/636; 99/643; 198/479

[58] Field of Search ..... 83/151, 154, 155, 155.1, 83/325, 409, 409.1, 401, 409.2, 410, 420, 421, 425, 425.2, 425.3, 435.1, 435.2, 743; 99/636, 643; 198/479, 653, 695, 696; 225/93, 101, 103; 414/225

[56] References Cited

U.S. PATENT DOCUMENTS

| | | | |
|---|---|---|---|
| 1,060,247 | 4/1913 | Ginaca | 83/435.2 X |
| 1,553,227 | 9/1925 | Feyk et al. | 83/409 |
| 1,813,340 | 7/1931 | Conti | 83/154 |
| 2,062,739 | 12/1936 | Canaday | 83/409.2 X |
| 2,494,914 | 1/1950 | Urschel et al. | 99/636 X |
| 2,712,334 | 7/1955 | Bridge | 83/409.1 X |
| 2,793,665 | 5/1957 | Pinard | 99/643 |
| 2,877,816 | 3/1959 | Kibler et al. | 83/409.1 X |
| 2,936,013 | 5/1960 | Kirshner | 99/636 X |
| 3,154,124 | 10/1964 | Cimino | 83/409.2 X |
| 3,330,400 | 7/1967 | Alexander | 198/479 |

*Primary Examiner*—Frank T. Yost
*Assistant Examiner*—Robert P. Olszewski
*Attorney, Agent, or Firm*—Harvey B. Jacobson

[57] ABSTRACT

An apparatus for trimming the top and the bottom from ears of corn to produce standardized size corn for packaging comprises a plurality of spring loaded clamps for holding individual corn pieces. The clamps are pivotally attached in a conveyor fashion and serve to transport the individual corn pieces past a pair of vertically spaced shearing blades. Each clamp includes an outer slidable member which rides on a cam surface. The cam surface pulls the sliding member away from a fixed member to release the corn cob after the slicing operation is completed. The cam surface holds the clamp open for insertion of additional corn pieces to be cut. A vertically adjustable gauge surface is disposed below the corn insertion position for determining the correct vertical trim position at which the corn is to be held.

9 Claims, 5 Drawing Figures

COB SAW

BACKGROUND OF THE INVENTION

1. Field of the Invention

This invention relates to slicing machinery and especially to devices adapted for automatic slicing of the ends of an ear of corn to produce ears of a standardized size.

2. Discussion of Related Art

Various mechanisms have been suggested in the past for trimming and processing vegetables. For instance, U.S. Pat. No. 1,553,227, issued Sept. 8, 1925 to Feyk et al, shows a slicing machine having a rotary conveyor containing a plurality of clamps, each of which clamps include one movable jaw and one stationary jaw. The movable jaw is displaced between an open and a closed position by a cam surface positioned at the center of the conveying apparatus. U.S. Pat. No. 2,062,739, issued Dec. 1, 1936 to Canaday, shows a corn cutting apparatus for severing the top and bottom from ears of corn. The ears of corn are vertically disposed in tubes attached to a circular conveying apparatus. The individual ears rest on a stationary plate and a cutout in the plate allows the ears to fall after the ends have been severed. U.S. Pat. No. 2,712,334, issued July 5, 1955 to Bridge, shows a vegetable trimming machine which uses a plurality of clamps linked together. Each clamp includes a pair of opposed arcuately shaped jaws for holding a vegetable in a vertical orientation. The Bridge device holds the vegetable firmly between the jaws while the vegetable is being cut and releases the vegetable after the cutting process. U.S. Pat. No. 2,961,023, issued Nov. 22, 1960 to Boyer, U.S. Pat. No. 3,349,822, issued Oct. 31, 1967 to Rauth, and U.S. Pat. No. 3,451,397, issued June 24, 1969, also to Rauth, show vegetable trimming machines which include a plurality of vegetable holding plate elements attached to a conveyor chain. Each vegetable holding element has a V-shaped surface for holding the vegetable in a horizontal plane while it is submitted to the slicing process.

SUMMARY OF THE INVENTION

One object of the present invention is to provide a corn cob slicing apparatus which can produce ears of corn having a uniform length.

A further object of the present invention is to provide a corn slicing apparatus which can produce a slicing function in a semi-automatic manner requiring only manual loading.

A still further object of the present invention is to provide a corn slicing apparatus which is easy to operate yet efficient and reliable in use.

In accordance with the above objects, the present invention includes a plurality of clamp devices having two arcuately shaped, opposed jaws with the clamps being attached in a flexible manner to form a conveyor chain. The opposed jaws of each clamp are slidably connected and biased to a closed position. Each jaw has a pair of outwardly extending support plates which guide the linked clamps along inner and outer support rails. The distance between the inner and outer support railsvaries to force the clamp to open or allow the clamp to close on an ear of corn. A vertically displaceable bottom support is positioned below the linked clamps to support the ears of corn when they are initially inserted into the clamps. The bottom support can be raised or lowered to adjust the cutting level on the ears.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
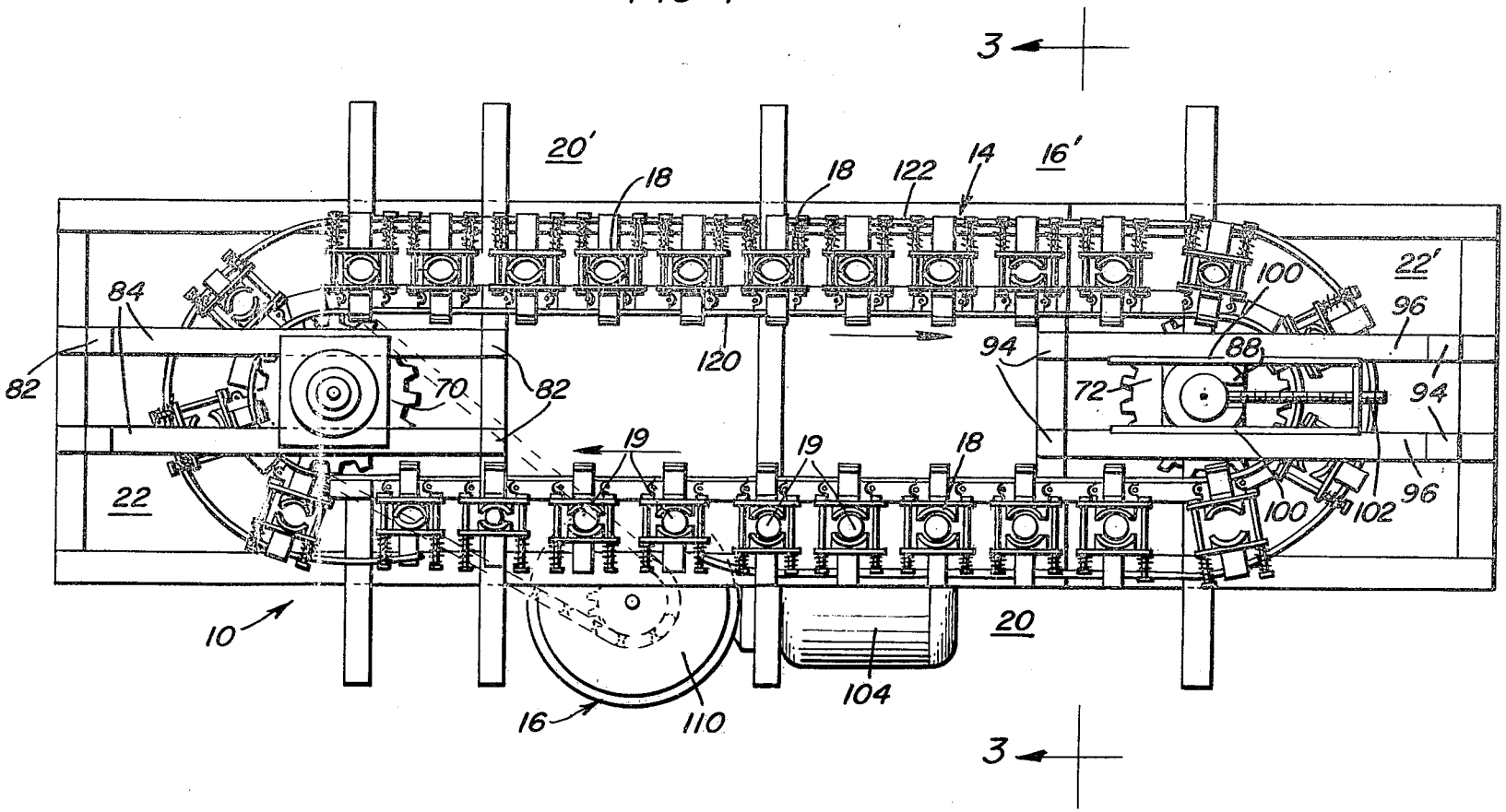
FIG. 1 is a top plan view of the cob saw forming the present invention.
Figure 2:
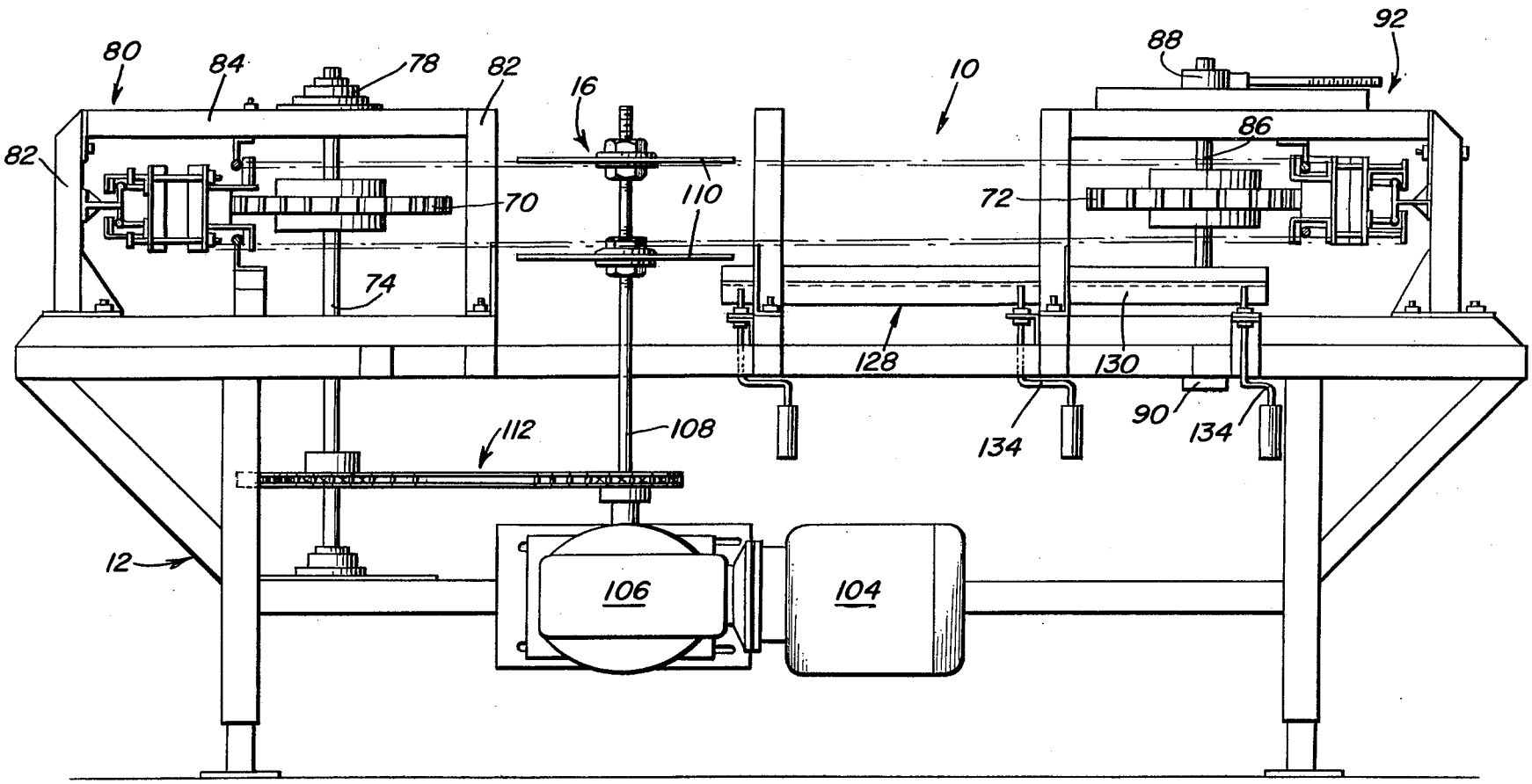
FIG. 2 is a side elevational view of the cob saw.
Figure 3:
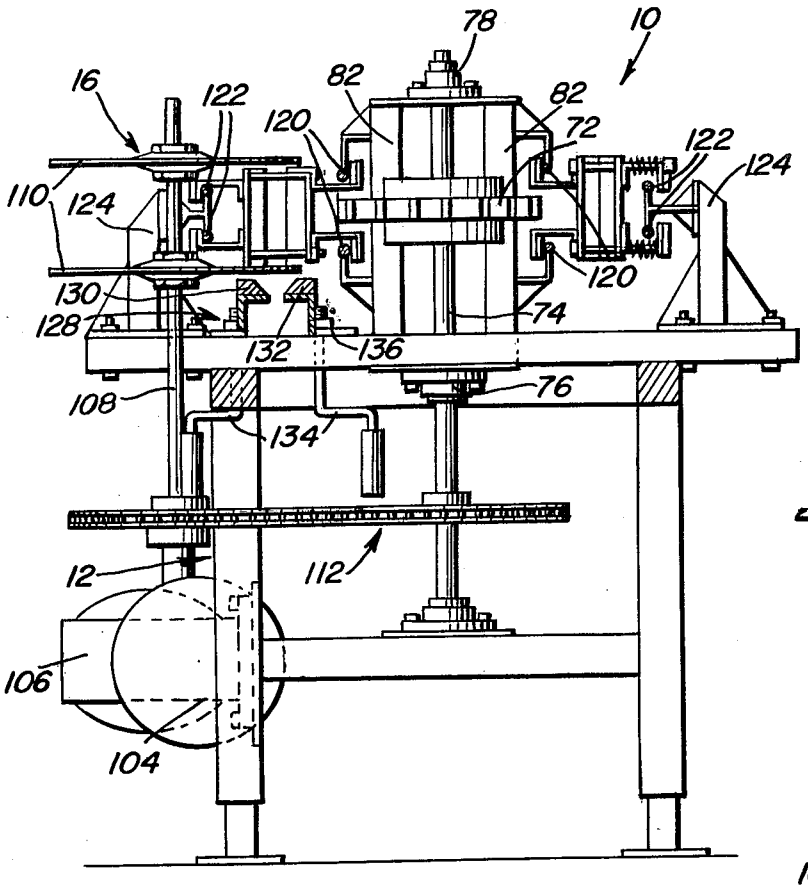
FIG. 3 is an end elevational view of the cob saw.

Now with reference to the drawings, a cob saw incorporating the principles and concepts of the present invention and generally referred to by the reference numeral 10 will be described in detail. With particular reference to FIGS. 1–3, it will be seen that the cob saw 10 comprises a base 12 which supports a corn cob transporting system 14 and shearing system 16. Transport 14 includes a plurality of clamps 18 which hold the individual ears of corn 19 in a vertical orientation. The clamps are linked together by a conveyor chain and sequentially pass the shearing system 16 whereat the top and bottom of each ear of corn is severed. The ears of corn 19 are manually loaded at loading station 20 where the clamps 18 are automatically opened. The clamps close down on the ears of corn, pass them through the shearing system 16 and open again to allow the corn to fall freely at discharge station 22.

Figure 4:
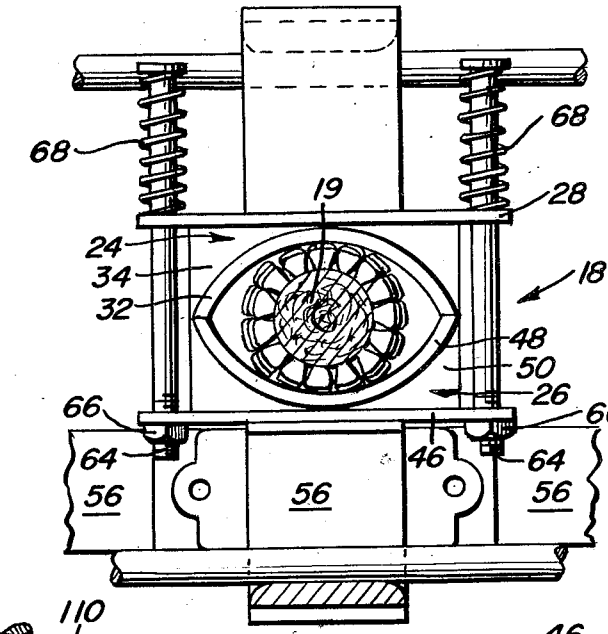
FIG. 4 is a fragmental top elevational view showing one clamp.
Figure 5:
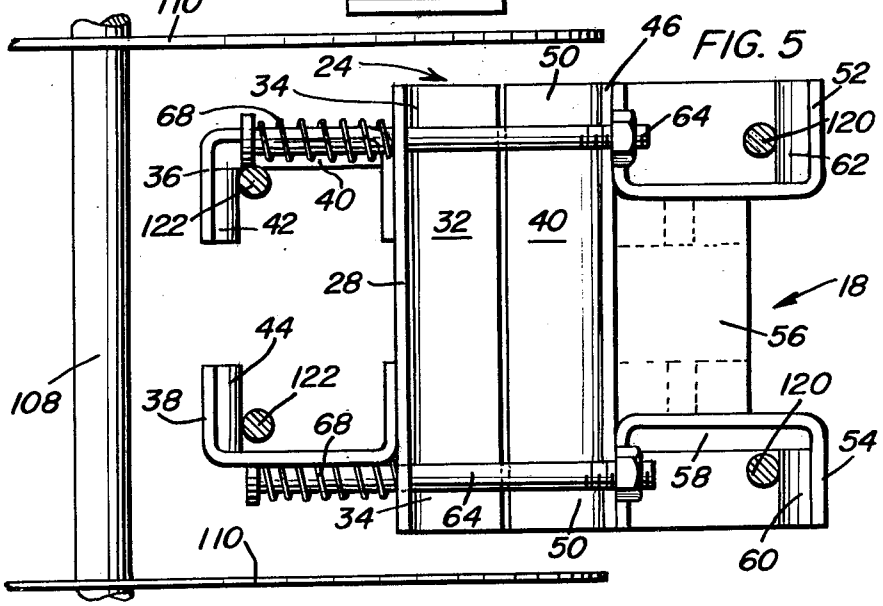
FIG. 5 is an end elevational view of the clamp of FIG. 4.

Each clamp 18, as shown in FIGS. 4 and 5, comprises a pair of jaws 24 and 26. Jaw 24 comprises a backing plate 28 which is mounted to arcuately shaped jaw surface 32 through the use of upper and lower mounting plates 34. The backing plate 28, jaw surface 32 and mounting plates 34 can be connected as by welding or any other suitable method. Also attached to the backing plate 28 on the opposite side from the surface 32 are two facing channel sections 36 and 38. Channel section 36 faces downwardly and includes horizontal and vertical bearing surfaces 40 and 42, while channel section 38 opens upwardly and includes a vertical bearing surface 44. Jaw 26 is formed in a similar manner with a backing plate 46 connected to an arcuate jaw surface 48 through the use of mounting plates 50. Backing plate 46 is also connected to two channel sections, designated 52 and 54. Channel sections 52 and 54 open away from each other and mount a chain link 56 between them. Chain link 56 can be a standard 2½ inch KVP chain link and is connected with other similar links 56 to form a conveyor chain which supports each of the clamps 18. A similar clamp 18 is mounted on every alternate link 56. It will also be noted that the downwardly opening channel section 54 includes horizontal bearing surface 58 and vertical bearing surface 60, while upwardly opening channel section 52 contains only a vertical bearing surface 62. The purpose of the bearing surface will be discussed hereinafter. The jaws 24, 26 are held together through the use of guide pins 64, four of which extend through backing plates 28, 46. Each guide pin 64 engages a separate nut 66 which is attached to backing plate 46. The guide pins then extend through openings disposed in the backing plates and extend away from backing plate 28 which is slidably mounted on the guide pins. A separate spring 68 is mounted on each guide pin and is disposed between the head of the associated guide pin and backing plate 28 to bias jaw 24 toward jaw 26, thus closing the clamp 18.

Transport system 14, as seen in FIGS. 1–3, includes clamps 18 interconnected by chain links 56 as discussed. Chain links 56 ride on a drive gear 70 and idler gear 72. Drive gear 70 is mounted on a drive shaft 74 which is supported and journaled in bearings 76 and 78. The bearings are mounted on a support structure 80 which comprises four pillars 82 interconnected at their top ends by longitudinal members 84. Similarly, the idler gear 72 is mounted on a shaft 86 which itself is supported and journaled in bearings 88 and 90 which are slidably mounted in support structure 92 comprised of uprights 94 and longitudinal members 96. Bearings 88 and 90 are mounted in slides, one of which is shown mounting bearing 88 in FIG. 1. The slide comprises side rails 100 and threaded member 102 which causes movement of the bearing along the side members for tensioning the chain comprising links 56.

A main drive motor 104 is attached to the side of the base 12. Motor 104 is connected to right angle drive 106. Right angle drive 106 rotates shaft 108 and through shaft 108 rotates shearing blades 110 which are mounted in vertical spaced relation on shaft 108. Shearing blades 110 are mounted above and below the position of clamps 18 in order to cut the top and bottom of each ear of corn which is held by the clamps and passed across blades 110. Shaft 74 is also driven by shaft 108 through chain and sprocket drive 112.

In order to guide, support and control the opening and closing of the clamps 18, a pair of inner guide rails 120 and a pair of outer guide rails 122 are provided. Guide rails 120 are mounted at various points along the support structures 80 and 92. Guide rails 120 contact bearing surfaces 60 and 62 which give lateral support to clamp jaws 26. The lower guide rail 120 contacts bearing surface 58 which gives vertical support to the clamp. In a similar manner, guide rails 122 are mounted on the support structures 80 and 92 as well as along support beams 124 which rise up from base 12. Guide rails 122 contact the vertical bearing surfaces 42 and 44 with the upper guide rail 122 contacting horizontal bearing surface 40. Accordingly, vertical support is provided to each clamp by the horizontal bearing surfaces 40, 58 and lateral support as well as control of the opening and closing of each clamp is provided by the horizontal bearing surfaces contacting their associated guide rails. The distance between the inner and outer guide rail pairs 120, 122 varies in accordance with the necessary actuation of the clamps. At loading station 20, the distance between the guide rails increases, as seen in FIG. 1, such that the jaws of clamps 18 are drawn apart opening each clamp to allow the manual insertion of an ear of corn 19 thereinto. As the clamps approach shearing system 16, the outer guide rails 122 curve inwardly thus allowing the clamps to close tightly on the ears of corn to hold them in place while the shearing operation commences. After shearing, the distance between the inner and outer guide rails again increases thus opening the clamps allowing the corn cobs to fall free at discharge station 22. Thus, it becomes apparent that additional loading stations, shearing systems and cutting stations can be established about the conveyor chain by merely adding additional blades 110 at a desired location such as shown at 16' in FIG. 1. The distance between the inner and outer guide rails would then be adjusted to provide additional loading and discharge stations such as shown at 20' and 22'.

In order to adjust the height of the ears of corn 19 as inserted in clamps 18, an adjustable bed 128, shown in FIGS. 1 and 2 is attached to base 12. Bed 128 comprises a pair of elongated bevelled supports 130 and 132 which have downwardly converging bevelled surfaces to engage either end of an ear of corn and support the ear within a clamp 18 until the clamp closes. Each support surface 130, 132 extends below the conveyor chain for a distance equal to that during which clamps 18 are kept open. Each of the support surfaces 130, 132 is adjustable in both vertical and horizontal positions. Vertical positioning is provided by cranks 134, each of which has one end connected to an associated support. Each of the cranks has a threaded portion which passes through a nut such that rotation of the crank causes the associated support 130, 132 to raise or lower. Each nut is attached to a plate 136 which is bolted to the base 12 in a manner such that the plate can be moved laterally in order to change the horizontal position of the associated support 130, 132.

In operation, it will be understood that the supports 130, 132 are adjusted in both vertical height and horizontal disposition to position ears of corn 19 at the desired height within clamps 18. Once this adjustment is accomplished, motor 104 can be started thus causing rotation of the shearing blades 110 and movement of the conveyor carrying the clamps 18. As the clamps approach loading station 20, they are opened by means of inner and outer guide rails 120, 122. The ears of corn are manually placed within the clamps 18 and supported by supports 130, 132. The ears are drawn along the supports 130, 132 until the distance between the inner and outer guide rails decreases to the point where the clamps grasp the ears 19 firmly. The clamps then carry the ears into engagement with blades 110 at which time the top and bottom of each ear of corn is severed. The ears are carried along to discharge station 22 at which time the distance between inner and outer guide rails 120, 122 again increases causing the clamps to open thereby allowing the ears to fall free.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a vegetable transporting and slicing apparatus, the combination of:

at least one vegetable clamp comprising a pair of vertically oriented opposed jaws and having spring biasing means for retaining said jaws in a normally closed relationship, whereby a vegetable may be retained and transported thereby, said at least one vegetable clamp being connected to an individual link of a conveyor chain;

guide means connected in operative relation to said at least one vegetable clamp for causing said jaws to move to an open position against said spring biasing means for facilitating the positioning of a vegetable within said jaws of said at least one clamp, said guide means comprising at least one inner guide rail spaced inwardly from said conveyor chain and one outer guide rail spaced outwardly from said conveyor chain;

vegetable support means for further facilitating a positioning of said vegetable within said at least one clamp and including a pair of elongated opposed support members, each of said support members being adjustable in height;

shearing means comprising a pair of shearing blades connected in a vertically spaced disposition; and movement means connected to said conveyor chain for causing movement of said at least one vegetable clamp between said shearing blades, thereby to facilitate a slicing of said vegetable being retained and transported by said at least one clamp.

2. The apparatus as defined in claim 1 and further wherein said each of said vegetable support members has at least one bevelled surface, such bevelled surfaces of said vegetable support members being disposed in an opposed downwardly converging relation for supportingly engaging a vegetable to be processed.

3. The apparatus as defined in claim 2 wherein each of said vegetable support members further includes horizontal adjustment means for providing individual horizontal adjustability.

4. In a vegetable transporting and slicing apparatus, the combination of:

at least one vegetable clamp comprising a pair of vertically oriented opposed jaws and having spring biasing means for retaining said jaws in a normally closed relationship, whereby a vegetable may be retained and transported thereby;

guide means connected in operative relation to said at least one vegetable clamp for causing said jaws to move to an open position against said spring biasing means for facilitating the positioning of a vegetable within said jaws of said at least one clamp;

vegetable support means for further facilitating a positioning of said vegetable within said at least one clamp and including a pair of elongated opposed support members, each of said support members being adjustable in height;

shearing means comprising a pair of shearing blades connected in a vertically spaced disposition;

movement means for causing movement of said at least one vegetable clamp between said shearing blades, thereby to facilitate a slicing of said vegetable being retained and transported by said at least one clamp;

said at least one vegetable clamp being connected to an individual link of a conveyor chain, said movement means comprising a motor driven gear connected to said conveyor chain and an idler gear spaced from said motor driven gear, said idler gear also being connected to said conveyor chain; and, said guide means comprising at least one inner guide rail spaced inwardly from said conveyor chain and one outer guide rail spaced outwardly from said conveyor chain.

5. The apparatus as defined in claim 4 and further wherein said vegetable support means includes gauging means adjustably raised or lowered to adjust the cutting level of the vegetable and the vegetable support means and said support means being adjustable in height by adjustment of the gauging means that supports and gauges the produce for a predetermined size of cut.

6. The apparatus as defined in claim 4 and further wherein said at least one vegetable clamp includes at least one inner extension disposed laterally of a first of said jaws, said inner extension overlapping said inner guide rail, and at least one outer extension extending laterally of a second of said jaws, said outer extension overlapping said outer guide rail.

7. The apparatus as defined in claim 6 and further including a second inner extension, said at least one inner extension and said second inner extension comprising a pair of diverging flange members.

8. The apparatus as defined in claim 7 and further including a second outer extension, said at least one outer extension and said second outer extension comprising a pair of converging flanges.

9. The apparatus as defined in claim 8 wherein said inner guide rail comprises a pair of vertically spaced bars, and further wherein said outer guide rail comprises a second pair of vertically spaced bars.

* * * * *